US009790891B2

(12) United States Patent
Moore, II

(10) Patent No.: US 9,790,891 B2
(45) Date of Patent: Oct. 17, 2017

(54) STIRLING ENGINE POWER GENERATION SYSTEM

(76) Inventor: James R. Moore, II, Louisville, KY (US)

( * ) Notice: Subject to any disclaimer, the term of this patent is extended or adjusted under 35 U.S.C. 154(b) by 127 days.

(21) Appl. No.: 13/173,141

(22) Filed: Jun. 30, 2011

(65) Prior Publication Data

US 2012/0000194 A1 Jan. 5, 2012

Related U.S. Application Data

(60) Provisional application No. 61/360,114, filed on Jun. 30, 2010.

(51) Int. Cl.

| | |
|---|---|
| ***F02G 1/04*** | (2006.01) |
| ***F01K 23/06*** | (2006.01) |
| ***F01K 23/10*** | (2006.01) |
| ***F04C 18/02*** | (2006.01) |
| ***F02G 1/043*** | (2006.01) |

(52) U.S. Cl.

CPC ..... *F02G 1/043* (2013.01); *F01K 23/06* (2013.01); *F01K 23/10* (2013.01); *F02G 2254/20* (2013.01); *F02G 2270/20* (2013.01); *F02G 2280/50* (2013.01); *F02G 2280/60* (2013.01); *F04C 18/0207* (2013.01)

(58) Field of Classification Search

CPC ..... F01K 23/00–23/18; F02G 1/00–1/06
USPC .... 290/2, 40 R; 60/650, 671, 682, 516–526; 417/379; 62/238.2, 6; 418/55.1; 74/567–569

See application file for complete search history.

(56) References Cited

U.S. PATENT DOCUMENTS

| | | | | |
|---|---|---|---|---|
| 2,907,178 | A * | 10/1959 | McNatt | 62/95 |
| 3,858,802 | A * | 1/1975 | Stobart | 237/12.1 |
| 4,178,772 | A | 12/1979 | Swenson et al. | |
| 4,293,384 | A * | 10/1981 | Weber | 376/391 |
| 5,088,284 | A | 2/1992 | Momose | |
| 5,722,239 | A | 3/1998 | Houtman | |
| 6,672,063 | B1 * | 1/2004 | Proeschel | 60/616 |
| 6,701,721 | B1 | 3/2004 | Berchowitz | |
| 6,715,313 | B1 | 4/2004 | Takafu | |
| 6,820,422 | B1 * | 11/2004 | Linney et al. | 60/651 |
| 7,043,909 | B1 * | 5/2006 | Steele | 60/517 |
| 7,459,799 | B2 | 12/2008 | Aldridge et al. | |
| 7,658,072 | B2 * | 2/2010 | Masada | 60/670 |
| 2002/0124561 | A1 * | 9/2002 | Ban et al. | 60/517 |
| 2003/0101724 | A1 * | 6/2003 | Zurawski et al. | 60/605.2 |

(Continued)

OTHER PUBLICATIONS

European Patent Office, International Search Report and the Written Opinion of the International Searching Authority, or the Declaration, Search Report and Written Opinion, Nov. 28, 2011, pp. 1-10, European Patent Office, the Netherlands.

(Continued)

*Primary Examiner* — Laert Dounis
(74) *Attorney, Agent, or Firm* — Middleton Reutlinger

(57) ABSTRACT

A Stirling engine power generation system comprises a first gas fired Stirling engine driving a scroll compressor to provide heat to a second Stirling engine powered generator. The second Stirling engine is partially submersed in a heat transfer medium that is heated by heat transfer fluid compressed by the Stirling scroll compressor and excess heat from gas firing. The invention further comprises a cam drive system with spherical cam followers, and multiple electrical generators.

13 Claims, 11 Drawing Sheets

(56) References Cited

U.S. PATENT DOCUMENTS

| | | | | |
|---|---|---|---|---|
| 2007/0074533 | A1* | 4/2007 | Hugenroth et al. | 62/467 |
| 2008/0127657 | A1 | 6/2008 | Fang et al. | |
| 2008/0159893 | A1 | 7/2008 | Caillat | |
| 2008/0216479 | A1 | 9/2008 | Romanelli et al. | |

OTHER PUBLICATIONS

Takuya Suganami, et al., Development of Small-Scale Stirling Engine Heat Pump System, Product Data Sheet, Aug. 12, 1990, pp. 264-267, vol. 5, Mitsubishi Electric Corp., Osaka Gas Co.

* cited by examiner

STIRLING ENGINE POWER GENERATION SYSTEM

CROSS-REFERENCE TO RELATED APPLICATIONS

This application claims the benefit of U.S. Provisional Application Ser. No. 61/360,114 entitled "Stirling Engine Power Generation System".

BACKGROUND OF THE INVENTION

Field of the Invention

The present invention relates generally to an improved Stirling engine system and more specifically to system for generating electrical power utilizing a Stirling compressor to provide heat transfer fluid to an improved Stirling engine generator to produce electrical power Description of the Related Art Currently, nearly fifty percent of the electricity consumed in the United States is generated by coal-fired power plants, which emit nearly 2,200 million metric tons of greenhouse gases yearly. Industrial concerns are the leading power consumer of electricity generated by coal. Industries consume nearly one-third of the electricity produced by coal, followed by residential power consumption at approximately twenty percent.

Producing power by burning coal is also disadvantageous in several other ways. Coal is not renewable, coal power generation requires millions of gallons of water for steam generators and cooling, and coal excavation often results in mountain-top removal and strip mining. These two mining techniques produce noxious wastewater that may spill into streams and other watercourses, thereby harming the environment. Many of these spills have proven catastrophic to the natural flora and fauna and surrounding communities.

Furthermore, producing electricity utilizing nuclear power provides many disadvantages as well. Nuclear waste disposal has become a contentious issue and as such, simply obtaining permits to build nuclear plants has become impossible. Additionally, nuclear plants, much like coal-fired plants, require enormous amounts of water to operate, and are also extremely expensive to build.

SUMMARY OF THE INVENTION

The present invention provides significant advantages over prior-art power generation systems by utilizing a gas-fired Stirling power generation system, supplied with heat transfer fluid produced by a Stirling engine driven scroll compressor operating as a highly efficient heat pump. The gas used to drive the system can be any naturally occurring hydrocarbon gas, synthetic gas, or anaerobically produced gas.

The concept of compressing fluid to create heat dates back the mid 1800s. In general, heat pump efficiencies are based upon Coefficient of Performance (COP) where the efficiency is simply calculated by dividing the energy into the system by the energy produced by the system. Modern air source heat pumps are capable of producing theoretically high COP's. This is possible because a heat pump transfers heat rather than converting it from a fuel. Prior art Stirling heat engines, while theoretically highly efficient, have not been widely commercially available until recent years, due to the precise tolerances required to manufacture efficient systems. More recently, Stirling engine technology has been coupled with natural gas and biogas combustion, as well as solar power, to produce efficient power generation. However, very few Stirling engines in the U.S. are commercially successful due to lack of a viable heat source.

The present invention provides a Stirling engine driven scroll compressor, that utilizes a gas fired burner to provide heat to a hot side of a Stirling engine. The engine is then used to drive a scroll-type compressor through a novel cam drive that translates the reciprocating motion of the Stirling engine to rotational motion. The scroll compressor compresses a refrigerant, or other suitable heat transfer fluid, to provide a heat transfer fluid to a Stirling engine-driven electrical generator.

The generator comprises a Stirling engine having a hot side that is immersed in the heat transfer fluid produced by the scroll compressor. Furthermore, excess heat produced by natural gas combustion is advantageously ducted to the hot side of the Stirling engine driven generator for enhanced efficiency. The Stirling engine drives an electrical generator, or a plurality thereof, through operation of a novel cam drive, thereby producing electrical power.

Other objects, features and advantages of the present invention will become readily apparent from the detailed description of the preferred embodiments taken in conjunction with the attached drawing Figures.

BRIEF DESCRIPTION OF THE DRAWING FIGURES

Figure 5:
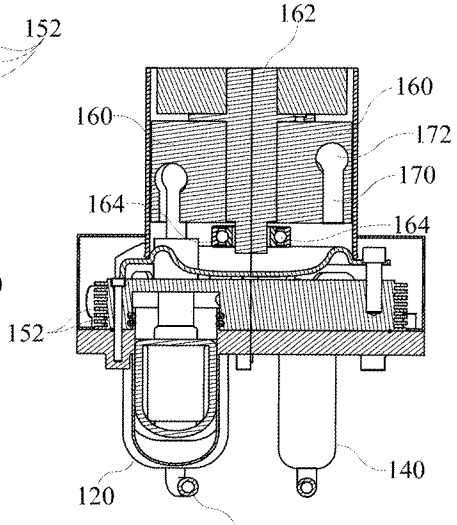
Figure 4:
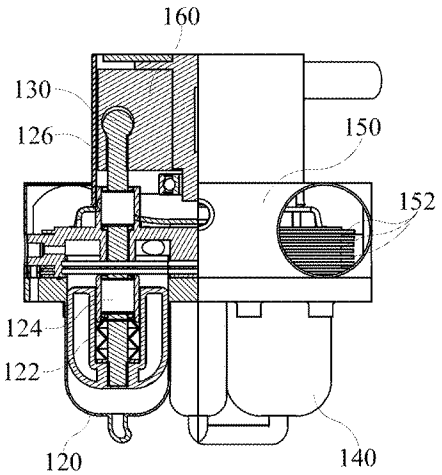
FIG. 4 is a partial cross-sectional view of a Stirling engine and cam drive in accordance with one embodiment of the present invention.

FIG. 5 a partial cross-sectional view of a Stirling engine and cam drive, with a partial cut-away view of engine cooling fins in accordance with one embodiment of the present invention.

Figure 6:
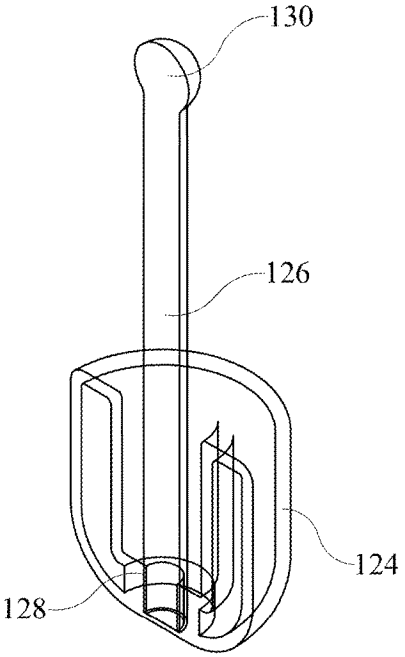

FIG. 6 is a partial cross-sectional view of a piston assembly in accordance with one embodiment of the present invention.

Figure 7:
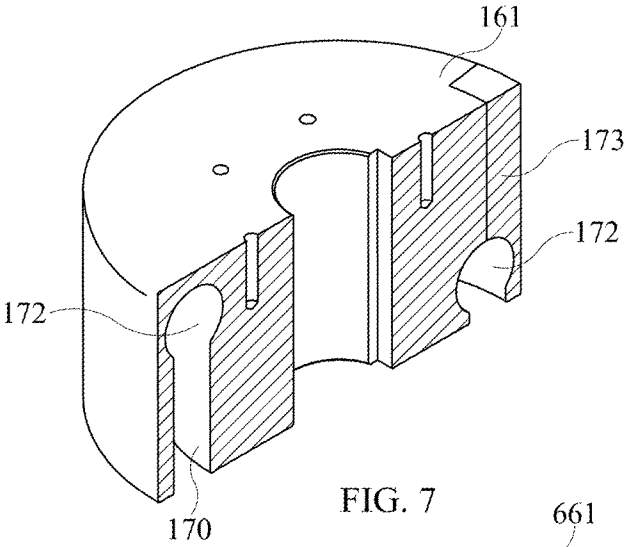

FIG. 7 is a partial cross sectional view of a cam drive in accordance with one embodiment of the present invention.

Figure 8:
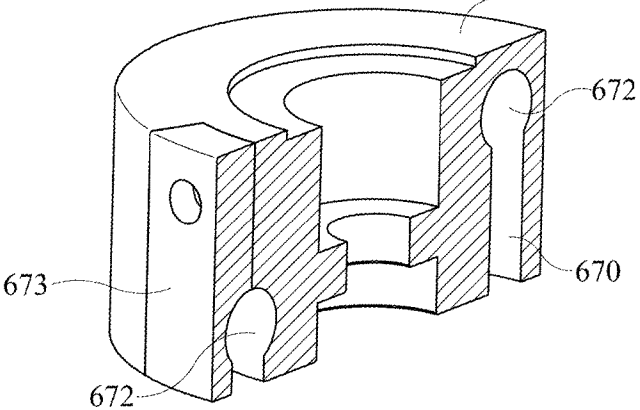

FIG. 8 is a partial cross-sectional view of a cam drive in accordance with one embodiment of the present invention.

Figure 9:
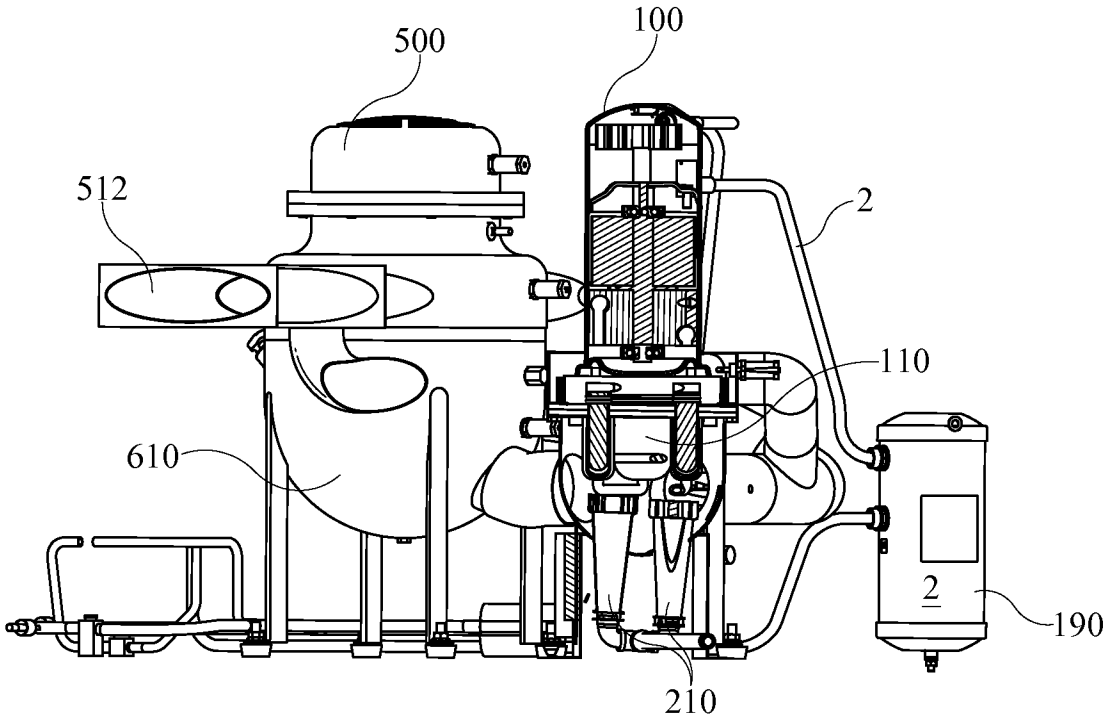

FIG. 9 is an elevation view of an improved Stirling engine power generation system in accordance with one embodiment of the present invention.

Figure 10:
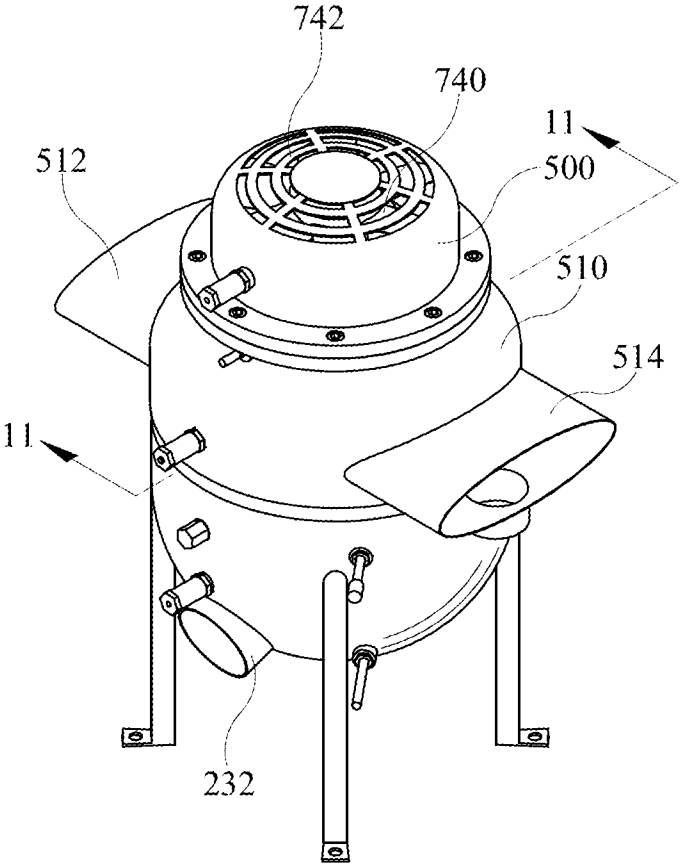

FIG. 10 is an isometric view of a Stirling generator in accordance with one embodiment of the present invention.

Figure 11:
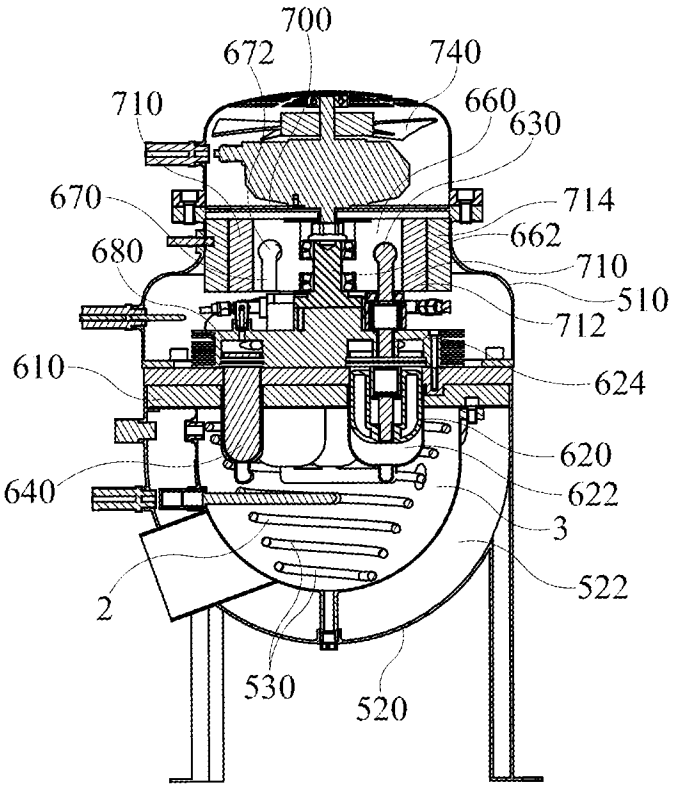

FIG. 11 is a cross sectional view of a Stirling generator taken along line 11-11 of FIG. 10 in accordance with one embodiment of the present invention.

Figure 12:
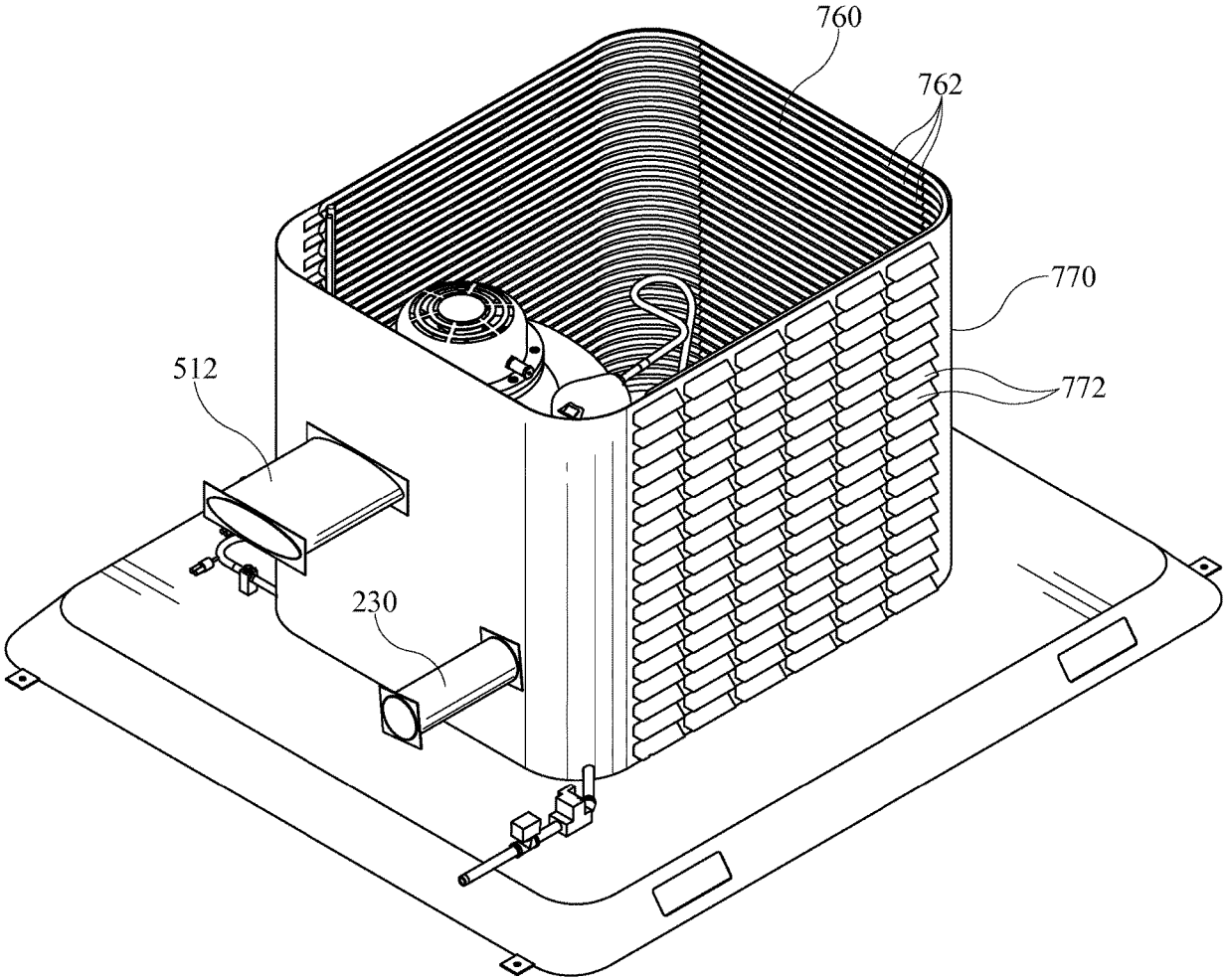

FIG. 12 is an isometric view of an improved Stirling engine power generation system in accordance with one embodiment of the present invention.

Figure 13:
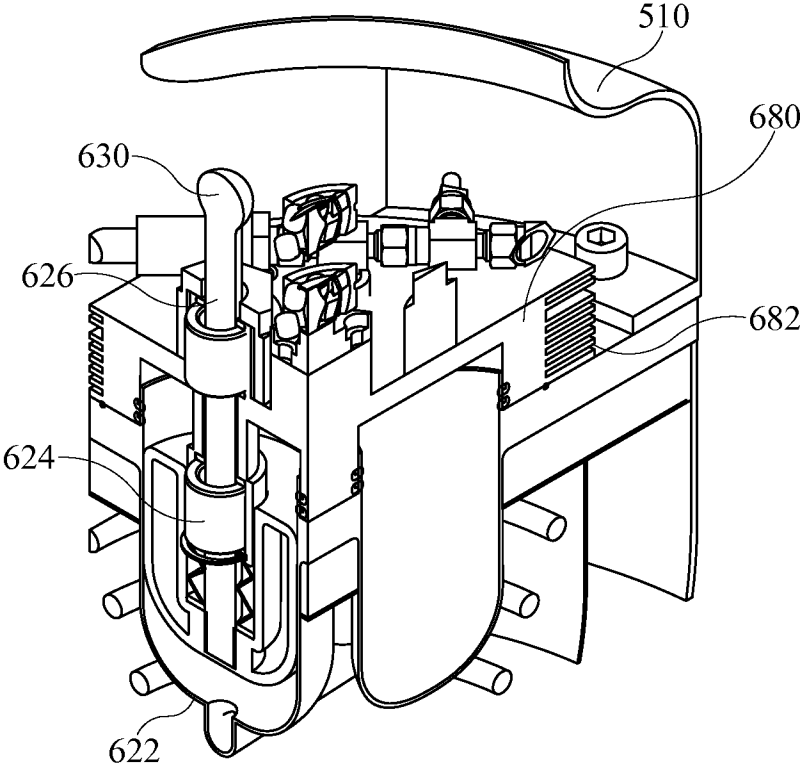

FIG. 13 is a partial cross-sectional view of a Stirling engine piston assembly in accordance with one embodiment of the present invention.

Figure 14:
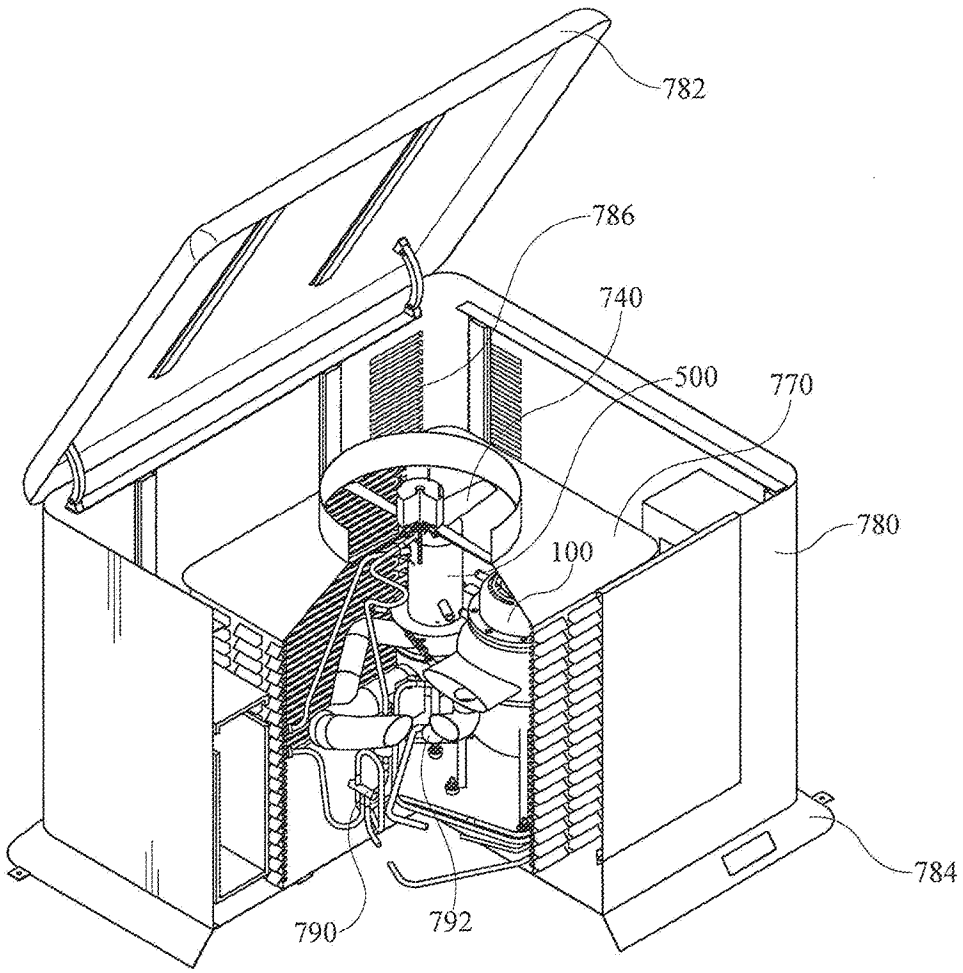

FIG. 14 is an isometric view of an improved Stirling engine power generation system in accordance with one embodiment of the present invention.

Figure 15:
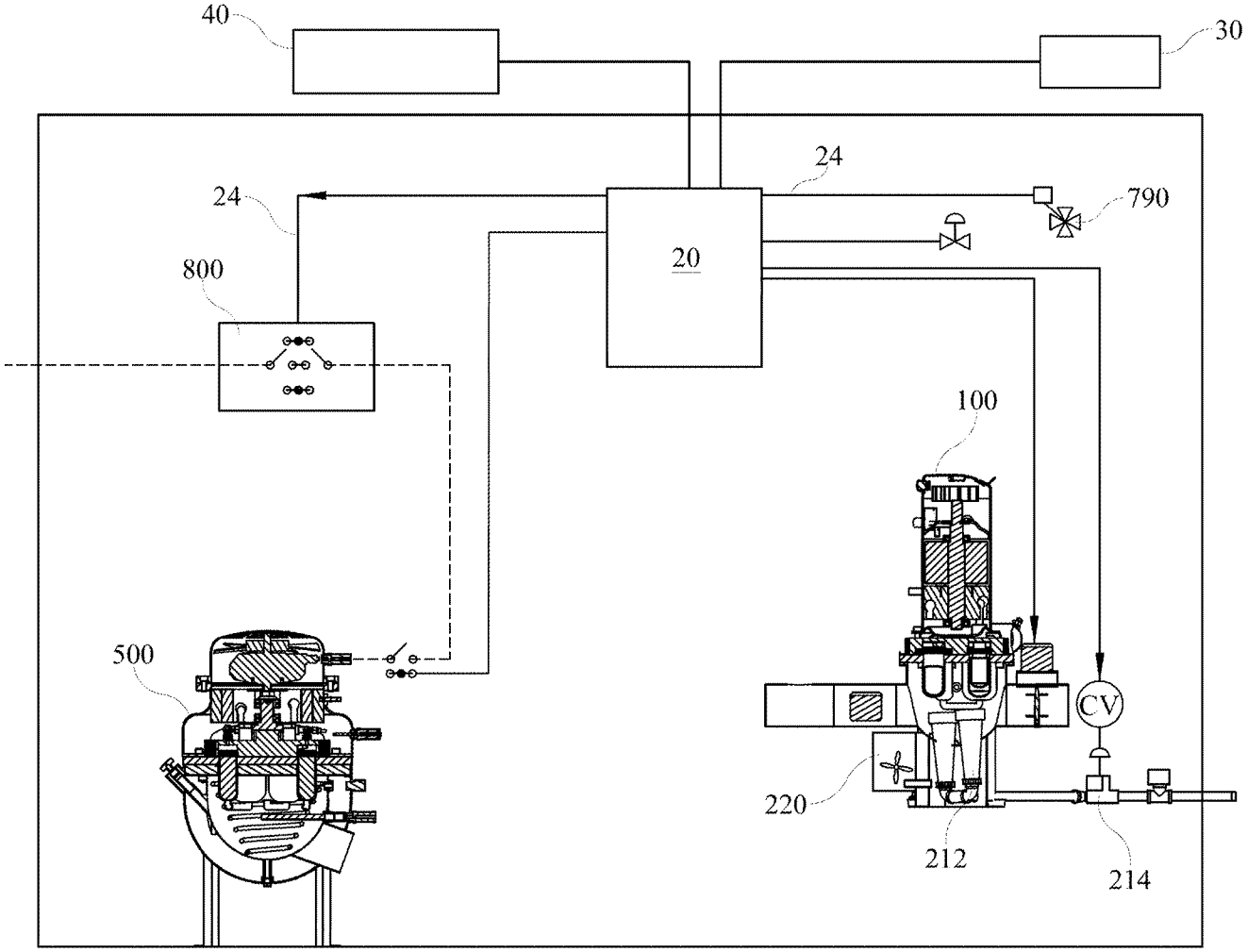

FIG. 15 is an instrumentation layout of an improved Stirling engine power generation system in accordance with one embodiment of the present invention.

Figure 16:
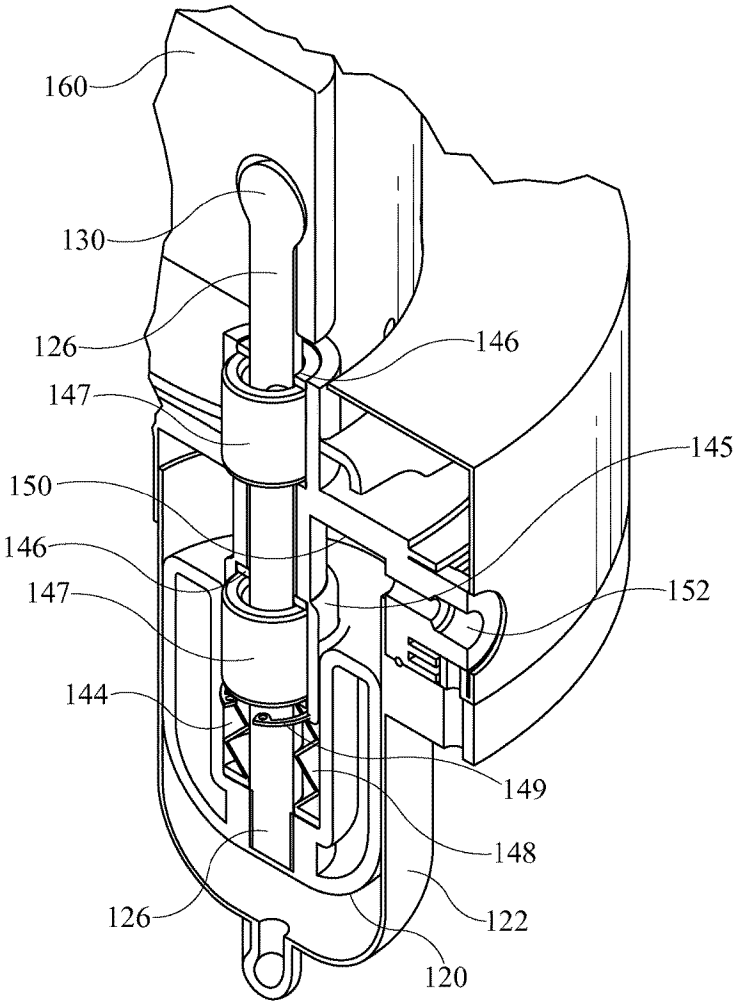

FIG. 16 is a partial cross-sectional view of a Stirling engine piston assembly in accordance with one embodiment of the present invention.

DETAILED DESCRIPTION OF THE PREFERRED EMBODIMENT(S)

Figure 1:
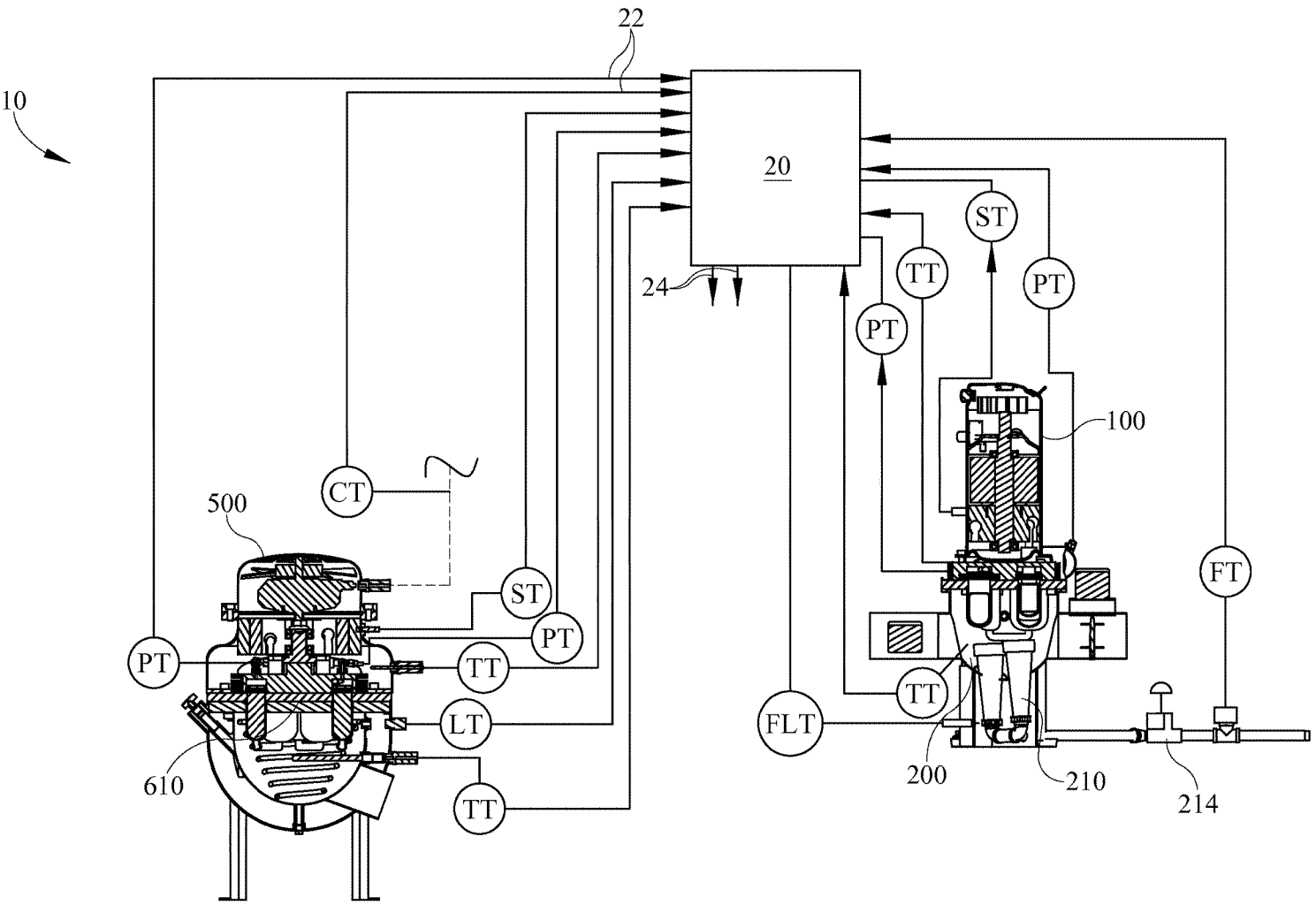
FIG. 1 is an instrumentation layout of an improved Stirling engine power generation system in accordance with one embodiment of the present invention.

Referring now to FIG. 1 and in accordance with one embodiment of the present invention a system 10 for generating electrical power comprises a Stirling scroll compressor 100 operates to supply a compressed fluid, for example a refrigerant 2, as a heating transfer fluid to a Stirling engine power generator 500 that produces electrical power for immediate use, or alternatively to supply to a power distribution system. A controller 20 is also provided to both control and monitor system 10 operation. Controller 20 comprises a microprocessor and concomitant data memory and also includes a plurality of input 22 and outputs 24. Inputs 22 accept electrical signals representative of system 10 parameters while outputs 24 provide electrical signals to actuate and control system 10. Both inputs 22 and outputs 24 may be either analog or digital signals as required. Furthermore controller 20 may comprise a programmable logic controller or the equivalent. A wide variety of controllers may be employed in the system 10 of the present invention without departing from the scope thereof.

Figure 3:
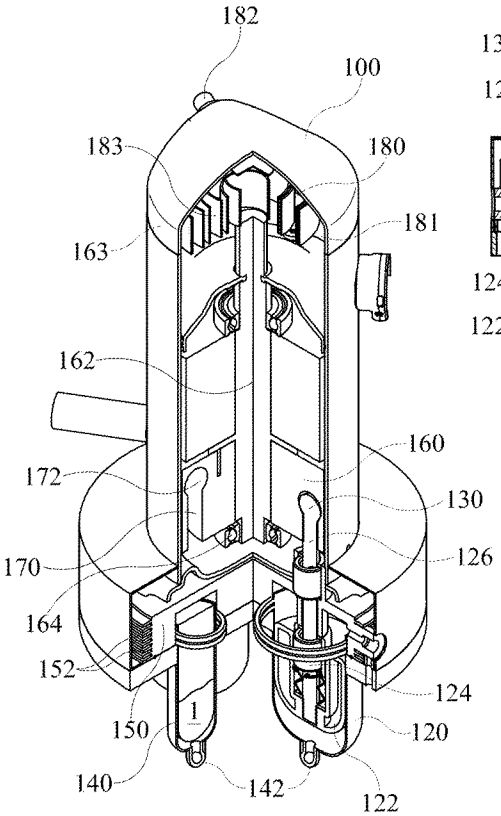
FIG. 3 is a partial cross-sectional isometric view of a Stirling engine driven scroll compressor in accordance with one embodiment of the present invention.

Scroll compressor 100 comprises a Stirling engine 110 that translates thermal energy into rotational motion to operate scroll compressor 100, thereby compressing a working fluid 1 for further use in system 10. FIG. 3 is a partial cross-sectional view of Stirling scroll compressor 100 depicting piston assembly 120. Piston assembly 120 includes a cylinder 122 inside which a piston 124 is mounted for reciprocating motion. As also seen in FIG. 6, piston assembly 120 comprises a piston rod 126 secured to piston 124 by a boss 128. Piston rod 126 terminates at an upper end thereof in spherical cam follower 130.

Stirling scroll compressor 100 also comprises a regenerator 140 that may contain a regenerator material such as metal mesh, metal gauze, porous carbon, or any one of a wide variety of materials suitable for use in heat transfer application. Regenerator 140 is in fluid communication with cylinder 122 via ports 142, which are typically connected by a pipe, not shown in FIG. 3. Stirling scroll compressor 100 engine 110 includes a cam drive 160 secured to a central shaft 162 that is journaled for rotation through bearings 164. Cam drive 160 translates the reciprocating motion of piston 124 and concomitant piston rod 126 into rotational motion to drive scroll compressor 100. FIGS. 7-8 depict cam drive 160 in greater detail. A cam track 170 in which cam follower 130 is disposed, has a groove 172 having a circular cross-section that describes a path that changes pitch through cam drive 160. In other words, cam track 170 groove 172 changes pitch with respect to a horizontal plane through cam drive 160. As piston rod 126 reciprocates cam follower 130 also reciprocates, forcing cam drive 160 to rotate as cam track 170 and groove 172 is engaged by cam follower 130.

In one embodiment of the present invention depicted in FIG. 16, piston assembly 120 further comprises a piston 124 having a bore 144 therein to accommodate a cylindrical journal 145 through which piston rod 126 is disposed. A shaft seal 146, or a plurality thereof, seals the area between journal 145 and piston rod 126 to prevent leakage of gas/fluid on either side of piston 124. Journal 145 additionally comprises a guide bushing 147, or a plurality thereof, and a bellows 148 that is disposed in bore 144 and secured to journal 145 via a snap-ring 149. Bellows 148 act to provide an hermetic seal between cylinder 122 and a cylinder bore 150, as piston 124 reciprocates around journal 145 and bushing 147. Shaft seal 146 may comprise one of any available high-temperature frictionless polymer shaft seals. Furthermore, bushing 147 may be comprised of bronze, or an equivalent alloy, coated with dry film lubricants to provide frictionless guidance for piston 124. Finally, an access port 152 is provided into cylinder bore 150.

As seen in FIG. 7 cam drive 160 may comprise two separable halves 161 to facilitate installation and removal of piston 124. Furthermore, cam drive half 161 may include a removable segment 173, a portion of which forms cam track 170 and groove 172, to facilitate installation of piston rod 126. This feature of the invention provides for ease of assembly and disassembly of piston assembly 120.

Referring again to FIG. 3 shaft 162 is secured to a plurality of scroll vanes 180 inside a compressor at an upper end 163 thereof. Upper end 163 of shaft may be shaped as an eccentric-to provide proper eccentric rotation of scroll vanes 180 such that they rotate eccentrically with respect to a complementary set of scroll vanes 183, to compress refrigerant 2. Scroll vanes 180, 183 cooperate to compress a refrigerant 2 stored in a receiver tank 190 compressor 100 through discharge port 182, which is then supplied to Stirling generator 500, as will be discussed herein below.

Referring again to FIGS. 1, 9, 12 and 15 Stirling scroll compressor 100 engine 110 further comprises an engine cylinder enclosure 200 that provides an enclosure for burner assembly 210. Burner assembly 210 includes a jet burner 212, or a plurality thereof, that is supplied with a source of, for example, natural gas 3 through gas valve 214 that is controlled or actuated by an output 24 from controller 20. Burner assembly 210 further comprises a fan 220 for blowing heated air produced by burner 212 across cylinder block 150 and fins 152, thereby transferring heat to working fluid 1 to operate engine 110. Fan 220 may be an electrically driven conventional fan.

Figure 2:
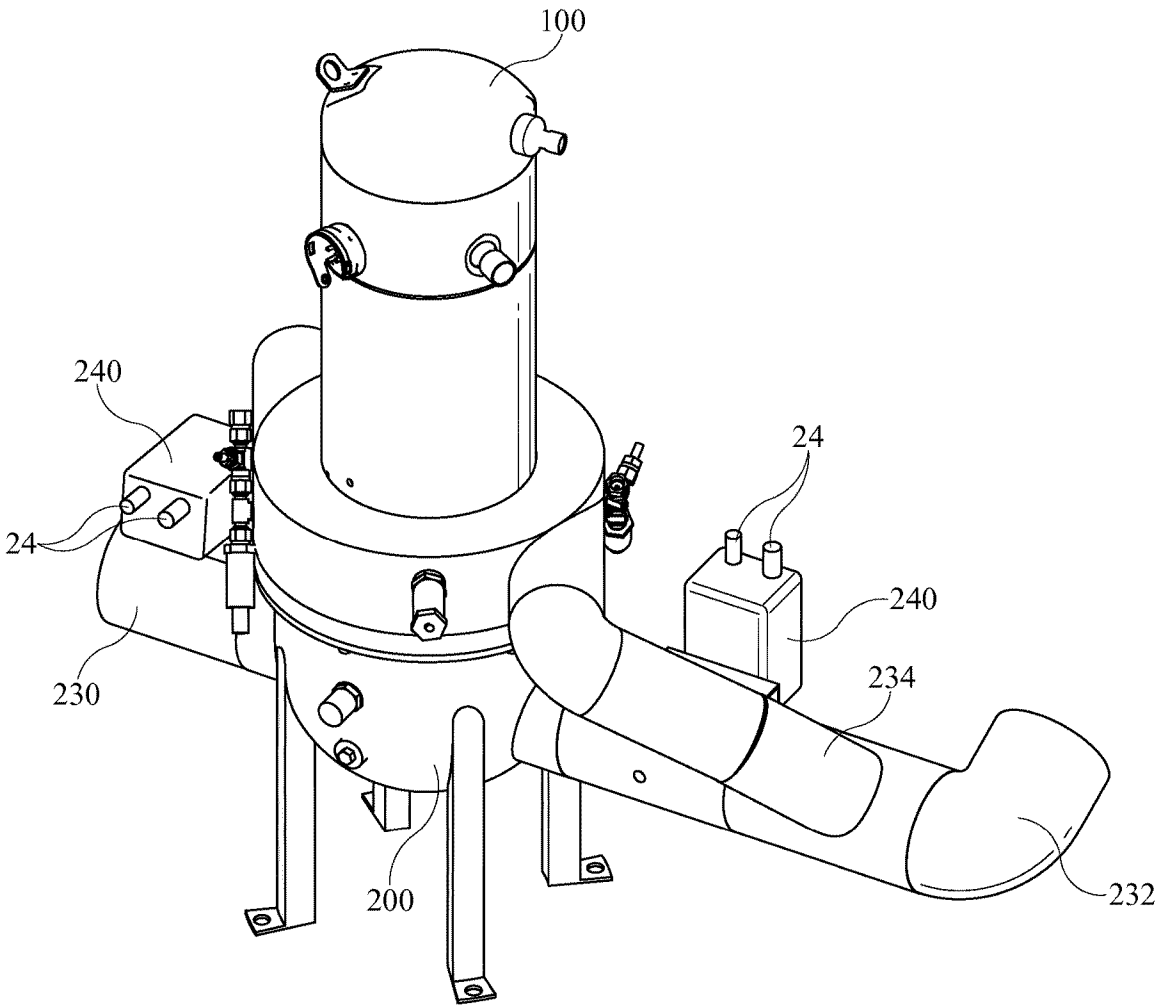
FIG. 2 is an isometric view of a Stirling scroll compressor in accordance with one embodiment of the present invention.

As best seen in FIG. 2, cylinder enclosure 200 additionally includes an air inlet 230 for supply air to be heated to engine 110, as well as an outlet air duct 232 for routing cooling air from to scroll compressor 100 engine 110. Air duct 232 is in fluid communication with a cooling air duct 234 that is also routed to the "cold" side of Stirling engine 10. Both inlet 230 and outlet air ducts 232 are equipped with electrically actuated butterfly valves 240 that are operably connected to an actuation output 24 from controller 20 to selectively control airflow through Stirling compressor 100. Butterfly valve 240 connected to outlet air duct 232 can be closed to block air through duct 232 that is being drawn through the "hot side" of Stirling engine 110. In this mode of operation, air being drawn through duct 230 is still drawing air through duct 234, thereby providing cooling air flow to the cold side of Stirling engine 110. Similarly, when butterfly valve 240 of duct 232 is open, cool air is drawn through the hot side of Stirling engine 110 as well, thereby slowing or stopping its operation. It should be noted that while Stirling engine 110 is depicted in the drawing Figures as a Gamma-type Stirling engine, other Stirling engine types (Alpha, Beta etc.) may be employed in the system of the present invention without departing from the scope thereof.

Referring now to FIGS. 1, 10 and 11 a Stirling power generator 500 constructed in accordance with one embodiment of the present invention comprises generator housing 510 having an ambient air inlet duct 512 for introducing ambient air into outer generator housing 510, shown in the Figs. as an elliptical inlet, 512 as well as a second inlet 514 for pulling air into generator housing 510 from a second side thereof. Inlets 512 and 514 may be fashioned in any shape necessary to admit sufficient cooling air to generator housing 510 without departing from the scope of the invention.

Outer enclosure 510 mates at a bottom portion thereof with a heat transfer fluid reservoir 520, in which is disposed a heat transfer medium 3 for providing heat to the "hot" side of Stirling generator 500 engine 610, as discussed in greater detail herein below. Fluid reservoir 520 may comprise an insulated shell 522 for retaining the heat within heat transfer medium 3, thereby enhancing the efficiency of engine 610. Inside fluid reservoir 520 is disposed a length of heat transfer tubing 530, shown in cross-section in FIG. 11 as a plurality of concentric spirals, for routing compressed (and thus hot) refrigerant 2 through heat transfer medium 3, and thereby heating said heat transfer medium 3 to provide energy to operate Stirling engine 610. In one embodiment of the present invention, heat transfer medium 3 may comprise a food-grade oil such as corn oil, vegetable oil, and other organic oils, which may be new or recycled through collection from fast-food facilities. These exemplary oils have higher boiling points than typical heat transfer mediums for stability as well as enhanced heat retention, and further aid in corrosion resistance of engine 610. In one embodiment of the present invention, heat transfer medium 3 has a boiling point of at least 300 degrees Fahrenheit to provide for efficient heat transfer to the hot side of Stirling engine 610. In accordance with another embodiment of the present invention, a plurality of synthetic oils may be used, including but not limited to polyester oils.

Stirling generator 500 comprises a Stirling engine 610 that translates thermal energy into rotational motion to operate generator 500. FIG. 11 is a partial cross-sectional view of Stirling engine 610 and generator 500. Stirling engine 610 is similar in construction and operation to engine 110 of Stirling scroll compressor, disclosed herein above. Engine 610 includes a piston assembly 620, including a cylinder 622 enclosing a reciprocating piston 624 having a piston rod 624 secured thereto and terminating at a distal end in a spherical cam follower 630.

A regenerator 640 is in fluid communication with cylinder 622, both of which contain a working fluid 1 as in conventional Stirling engines 610. Regenerator 640 may contain a material such as metal mesh, gauze, or other equivalent heat transfer materials to enhance heat transfer to working fluid 1 therein.

Referring to FIGS. 8 and 11, Stirling engine 610 further comprises a cam drive 660, similar in construction to cam drive 160 as depicted in FIG. 7, that is secured to a central drive shaft 662 for driving Stirling generator 500. Cam drive 660 translates the reciprocating motion of piston 624 and piston rod 626 into rotational motion of central shaft 662 to drive generator 500, and is secured to shaft 662 to effect rotation thereof. Cam drive 660 includes a cam track 670 in which piston rod 626 reciprocates, terminates in a groove 672 that describes a circular path through cam drive 660 that changes pitch with respect to a horizontal plane 662. This "tilted" cam track 670 provides rotational motion as piston 624 reciprocates causing cam follower 630 to engage groove 672, thereby rotating cam track 670.

As seen in FIG. 8 cam drive 660 may comprise two separable halves 661 to facilitate installation and removal of piston 624. Furthermore, cam drive half 661 may include a removable segment 673, a portion of which forms cam track 670 and groove 672, to facilitate installation of piston rod 626. This feature of the invention provides for ease of assembly and disassembly of piston assembly 620.

It should be noted that in one embodiment of the invention, cam drive 660, as well as cam drive 160, may be manufactured from a wear-resistant metal alloy, with cam tracks 670, 170 as well as groove 672, 172 surfaces finished to a mirror finish. Additionally, cam tracks 670, 170 and grooves 672, 172 may be coated with dry film lubricants or other equivalent wear and heat-resistant coatings without departing from the scope of the present invention.

As best seen in FIG. 13, Stirling engine 610 further comprises an engine head 680 having a plurality of cooling fins 682 extending therefrom across which cooling air is passed to cool working fluid 1 and thus complete the regenerative Stirling engine 610 cycle.

Referring again to FIGS. 1, 10 and 11 Stirling generator 500 may comprise a pancake or flat disc segmented magnet generator 700 (for example a motional emf generator) which is secured to shaft 626 to effect rotational motion and thus generate electrical current. Furthermore, a second electrical generator 710 is provided, comprising a rotor 712 secured to an outer circumference of, and consequently rotating with cam drive 660. A stator assembly 714 is disposed radially outwardly of rotor 712, whereby the rotating rotor 712 induces emf in stator 712 coils, as is known in conventional electrical power generators. It should be noted that the invention can be operated without either generator 700, or generator 710, or with both generators present. Thus the present invention may incorporate a generator 500 having a plurality of electrical generators 700 and 710 driven by Stirling engine 610, thereby providing an efficient and convenient power source.

Stirling generator also includes a fan 740 is secured to shaft 626, which extends upwardly through generator 700, to provide cooling airflow through Stirling generator 500. Air is pulled by fan 740 through ambient air inlet 512 and second inlet 514 into enclosure 510 to provide cooling air to engine head 680 cooling fins 682 on the "cool" side of Stirling engine 610. This cooling air is then exhausted through perforated fan cover 742. Furthermore, fan 740 operates to pull air from Stirling compressor 100 through outlet duct 232 into the area surrounding fluid reservoir 520, to provide additional heat to Stirling engine 610 for operation of generator 500. By closing butterfly valve 240 controlling hot air exiting Stirling scroll engine 110 through outlet 232, the amount of heat transferred to engine 610 of Stirling generator 500 may be reduced, thus slowing down the operation of Stirling generator 500 as necessary. Thus it may be seen that by controlling the amount of heated airflow routed to Stirling engine 610 from Stirling engine 110, butterfly valve 240 may be used to control operation of Stirling engine 610.

As best seen in FIG. 12 a heat transfer coil 760 comprising a plurality of refrigerant tubing circuits 762 may be routed and mounted on a system enclosure 770. Enclosure 770 may cover and protect both Stirling scroll compressor 100 and Stirling generator 500 and include a plurality of louvers in an exterior surface thereof for the admission of ambient air. The heat transfer coil 760 provides cooling to refrigerant 2 as it expands into coil 760 upon exiting Stirling engine 610 fluid reservoir 520.

In a yet further embodiment of the invention depicted in FIG. 14, an overall enclosure 780 may be provided, in which enclosure 770 is placed. Enclosure 780 may include a removable or hinged lid 782 for ease of access to system 10, as well as a base 784 to protect system 10 from water and other contaminants. Overall enclosure 780 may further have a plurality of louvers 786 therein that provide a means to mix ambient air with warmer air that is already inside overall enclosure 780 as it is exhausted from enclosure 770 by fan 740. This feature of the invention allows system 10 to operate much more efficiently since heat is retained within outer enclosure 780.

Additionally, system 10 includes a plurality of control valves CV that are actuated by outputs 24 from controller 20. As one example seen in FIG. 15, a control valve CV is provided for gas valve 214 that is responsive to an output 24 from controller 20 to electrically control the operation of jet burner 212, thereby controlling the amount of heat supplied to Stirling scroll engine 110.

Referring now to FIG. 15 and in accordance with one embodiment of the invention, controller 20 may be operably connected to an operator interface 30, for example a personal computer, personal digital assistant, touch screen interface, or any other equivalent interface that enables controller 20 to provide feedback signals to interface 30, and enables interface 30 to provide operating signals to controller 20. Furthermore, a data communications module 40 may also be operably connected to controller 20, whereby data pertaining to system 10 operating conditions may be stored and transmitted to other devices. Module 40 may be a wireless data module and further may record data representative of system 10 pressures, temperatures, power generation parameters, system 10 faults etc. As best seen in FIGS. 1 and 15, system 10 may further comprise a plurality of pressure transmitters PT, speed transmitters ST, Flow Transmitters FT, temperature transmitters TT, current transmitters CT, level transmitters LT and flame detection transmitters FLT. Each of these instruments provides an input signal to controller 20 representative of its measured parameter, whereby controller 20 utilizes said signals to operate system 10 according to software instructions provided in data memory of controller 20, as is known in the art. For example, a current transmitter CT provides a signal input 22 to controller 20 representative of the amount of electrical current being produced by generator 500. This signal may then be monitored by controller 20 to reduce or increase the speed (and thus output) of generator 500 as desired.

Additionally, system 10 includes a plurality of control valves CV that are actuated by outputs 24 from controller 20. As one example seen in FIG. 15, a control valve CV is provided for gas valve 214 that is responsive to an output 24 from controller 20 to electrically control the operation of jet burner 212, thereby controlling the amount of heat supplied to Stirling scroll engine 110. As a yet further example seen in FIG. 14, a pressure regulation valve 792 may be provided for regulating the pressure of the heat transfer fluid 2 supplied to Stirling generator 500.

In a yet further embodiment of the invention, and as seen in FIGS. 14 and 15, system 10 comprises a reversing valve 790, having a plurality of ports in fluid communication with refrigerant tubing 762 proximate Stirling compressor 100. Reversing valve 790 is a four-way valve that is operably connected to an output 24 from controller 20 whereby reversing valve 790 may be actuated to reverse the flow of refrigerant to Stirling compressor 100, thereby switching Stirling compressor 100 from a heating to a cooling mode of operation. This feature of the present invention is particularly useful for slowing down and/or stopping the operation of Stirling generator 500 engine 610.

While in operation generator 500 provides electrical power that is rotated through a power switch 800 that may be actuated by an output 24 from controller 20. Power switch 800 may be wired to supply the electrical power produced by generator 500 to any of a wide variety of uses, for example residential power, or to supply power to a power distribution system or grid. Similarly, switch 800 may be opened to remove system 10 from a power distribution system or residential application when system 10 is not producing power. Additionally, the power produced by generator 500 may be utilized to supply electrical power to the requisite electrical components of system 10 by operation of a transformer or transformers (not shown) for providing power having the required voltage and current to operate system 10 components.

In accordance with one embodiment of the invention, Stirling scroll compressor 100 may be operated separately from Stirling generator 500. In this embodiment of the invention, Stirling generator 500 may comprise its own gas burner assembly 210, to provide heat to heat transfer medium 3. Stirling scroll compressor 100 may then be operated independently to provide heating and/or cooling to, for example a residential structure, while Stirling generator 500 provides electrical power to the structure. This feature of the invention provides for a modular system 10 that supplies both climate control and electrical power to an application.

Furthermore, and in accordance with another embodiment of the invention, a plurality of Stirling scroll compressors 100 may be disposed either in series or in parallel to provide enhanced heat transfer fluid 2 compression (and thus heating) for use either in conjunction with Stirling generator 500, or independently.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. An improved electrical power generation system comprising:

a first Stirling cycle engine having at least one piston driven by a hot gas, said first Stirling cycle engine also having an outlet air duct;

a scroll compressor driven by said first Stirling cycle engine for compressing a heat transfer fluid;

an insulated reservoir containing a heat transfer medium and a closed-loop heat transfer coil containing said heat transfer fluid submersed in said heat transfer medium;

a second Stirling cycle engine having at least one piston driven by expansion of said heat transfer medium and a housing enclosing said second Stirling cycle engine and said insulated reservoir, said housing in fluid communication with said outlet air duct of said first Stirling cycle engine; and a generator having a driven shaft for producing electrical power operatively coupled to said second Stirling cycle engine.

2. An improved electrical power generation system as claimed in claim 1 comprising:

a piston of said first Stirling engine having a piston rod secured thereto, said piston rod terminating in a cam follower; and a cam drive capable of rotational motion having a circular groove therein for engaging said cam follower, said cam drive secured to said compressor whereby said cam drive rotates said compressor.

3. An improved electrical power generation system as claimed in claim 2 wherein said cam drive rotates a scroll to compress said heat transfer fluid.

4. An improved electrical power generation system as claimed in claim 1 comprising:

a generator housing enclosing said second Stirling engine and said insulated reservoir, said housing in fluid communication with said hot gas to provide heat transfer to said second Stirling engine.

5. An improved electrical power generation system as claimed in claim 4 comprising:

a scroll compressor housing enclosing said first Stirling engine and said scroll compressor, and a gas burner disposed proximate said first Stirling engine for providing heat transfer thereto; and a fan driven by said second Stirling engine for pulling said hot gas from said first Stirling engine into said housing enclosing said second Stirling engine to provide heat transfer to said second Stirling engine.

6. An improved electrical power generation system as claimed in claim 5 comprising:

an enclosure surrounding said scroll compressor housing and said generator housing for retaining heat within said system.

7. An improved electrical power generation system as claimed in claim 5 comprising:

a four-way reversing valve in fluid communication with said heat transfer fluid coil for reversing the direction of flow of said heat transfer fluid through said scroll compressor.

8. An improved electrical power generation system as claimed in claim 1 comprising:

a controller having a microprocessor and concomitant data memory, and further having a plurality of inputs and outputs for receiving and supplying electrical signals from said power generation system.

9. An improved electrical power generation system as claimed in claim 8 wherein said controller comprises a programmable logic controller.

10. An improved electrical power generation system as claimed in claim 1 wherein said heat transfer medium has a boiling point of at least 300 degrees Fahrenheit.

11. An improved electrical power generation system as claimed in claim 1 wherein said heat transfer medium is a food grade oil.

12. An improved electrical power generation system as claimed in claim 1 wherein said heat transfer medium is a synthetic oil.

13. An improved fluid compression system comprising:

a Stirling cycle engine having at least one piston driven by a hot gas said Stirling cycle engine also having an outlet air duct;

a scroll compressor driven by said first Stirling cycle engine for compressing a heat transfer fluid;

a piston of said Stirling engine having a piston rod secured thereto, said piston rod terminating in a cam follower;

a cam drive capable of rotational motion having a circular groove therein for engaging said cam follower, said cam drive secured to said compressor whereby said cam drive rotates said compressor;

an insulated reservoir containing a heat transfer medium and a closed-loop heat transfer coil containing said heat transfer fluid submersed in said heat transfer medium;

a second Stirling cycle engine having at least one piston driven by expansion of said heat transfer medium and a housing enclosing said second Stirling cycle engine and said insulated reservoir, said housing in fluid communication with said outlet air duct of said first Stirling cycle engine; and a generator having a driven shaft for producing electrical power operatively coupled to said second Stirling cycle engine.

* * * * *